US006561107B1

(12) United States Patent
Wood et al.

(10) Patent No.: US 6,561,107 B1
(45) Date of Patent: May 13, 2003

(54) FOLDABLE SHELF ASSEMBLY

(75) Inventors: George W. Wood, Minnetonka, MN (US); Julie R. McAdam, Minnetonka, MN (US)

(73) Assignee: Lockermate Corporation, Minneapolis, MN (US)

( * ) Notice: Subject to any disclaimer, the term of this patent is extended or adjusted under 35 U.S.C. 154(b) by 0 days.

(21) Appl. No.: 09/860,741

(22) Filed: May 18, 2001

Related U.S. Application Data

(60) Provisional application No. 60/205,810, filed on May 19, 2000.

(51) Int. Cl.[7] ..... A47B 3/00

(52) U.S. Cl. ..... 108/132; 108/133

(58) Field of Search ..... 108/131, 132, 108/129, 115, 133; 292/177, 175; 248/439

(56) References Cited

U.S. PATENT DOCUMENTS

| | | | | |
|---|---|---|---|---|
| 1,300,861 | A | * | 4/1919 | Otte |
| 1,309,774 | A | * | 7/1919 | Otte |
| 1,549,146 | A | | 8/1925 | Miner |
| 1,709,928 | A | * | 4/1929 | Whitney |
| D113,409 | S | | 2/1939 | Vavrik |
| 2,490,318 | A | * | 12/1949 | Padon |
| 2,669,793 | A | * | 2/1954 | Foster |
| 2,690,942 | A | * | 10/1954 | Marcus |
| 2,823,087 | A | * | 2/1958 | Zimmer |
| 3,322,077 | A | | 5/1967 | Kovacik |
| D229,261 | S | | 11/1973 | Russo |
| 3,905,286 | A | | 9/1975 | Le Grady |
| 4,191,160 | A | | 3/1980 | Elliott |
| 4,500,146 | A | | 2/1985 | Peterson |
| 4,557,200 | A | * | 12/1985 | Geschender |
| 4,953,473 | A | | 9/1990 | Tomaka et al. |
| 5,035,335 | A | | 7/1991 | Massoudnia |
| 5,074,223 | A | | 12/1991 | Remmers |
| 5,097,971 | A | | 3/1992 | Norris et al. |
| 5,137,160 | A | | 8/1992 | Santucci |
| 5,152,407 | A | | 10/1992 | Massoudnia et al. |
| 5,421,646 | A | | 6/1995 | McNamara et al. |
| 5,746,331 | A | | 5/1998 | Kurtis |
| D413,218 | S | | 8/1999 | Doty |

* cited by examiner

*Primary Examiner*—Jose V. Chen

(57) ABSTRACT

A foldable wire shelf assembly having a shelf with crossed wires attached to a peripheral frame. U-shaped leg supports have upwardly directed legs cooperating with connectors secured to the shelf support the shelf. The connectors have upright spaced flanges for holding the legs normal to the plane of the shelf.

15 Claims, 8 Drawing Sheets

FOLDABLE SHELF ASSEMBLY

CROSS REFERENCE TO RELATED APPLICATION

This application claims the priority benefit of U.S. provisional application Ser. No. 60/205,810 filed May 19, 2000 now U.S. Pat. No. D457,752S.

FIELD OF THE INVENTION

The invention relates to free standing shelf assemblies having horizontal shelves attached to legs and more particularly to shelf assemblies having foldable legs that can be locked in upright positions and pivoted to folded positions adjacent the shelves.

BACKGROUND OF THE INVENTION

Storage enclosures are used in a number of environments, such as schools, fitness centers, industrial, commercial, and military institutions for storage of items, as books, clothing, shoes, and sporting accessories. One form of an enclosure is a school locker comprising an upright metal cabinet having side walls extended upwardly from a horizontal floor. A shelf attached to the side walls located in the upper portion of the locker has attachments to hang clothing in the locker chamber. Additional shelves are not located in conventional lockers. Additional shelf space in a locker is useful to support items and allow shoes and boots to be placed on the locker floor and separated from other items, such as books, papers and backpacks. Additional shelves used in lockers and enclosures are disclosed in the locker shelf and rack art as described and illustrated in the following patents.

H. Kovacik in U.S. Pat. No. 3,322,077 describes a foldable table stand having a pair of upright front and rear tubular legs having holes and slots. A pair of shelves are pivotally mounted on one of each pair of legs for movement between generally horizontal positions and folded generally upright positions. Each shelf has rods with ends that fit into the holes and slots to pivotally mount the shelves and retain the shelves in generally horizontal positions.

T. A. Burton in U.S. Pat. No. 4,283,099 discloses a cabinet that can be installed within the inside space of a locker. The cabinet is a kit having side panels and horizontal shelf panels extend between and mounted on the side panels. Opposite ends of the shelves have downwardly extended flanges that hook on brackets attached to the side panels to mount the shelves on the side panels. A drawer is slidable located between adjacent shelf panels. The cabinet is retained within the locker by the shelf panels attached to the side panels. The cabinet has a width greater than the width of the locker door opening whereby the cabinet must be taken apart to remove it from the locker.

R. R. Peterson in U.S. Pat. No. 4,500,146 discloses a laterally adjustable shelf assembly adapted to fit in a locker. The shelf assembly has a pair of shelves attached to four upright legs which support the shelves in the locker. Each shelf has first and second shelf members with cooperating guides that allow lateral expansion of the shelf to fit in different size lockers. A nut and bolt hold the shelf members in their laterally adjusted positions. The legs have vertical slots that accommodate male connectors to connect the legs to corner portions of the shelves and retain the legs in upright positions to support the shelves above the floor of the locker.

L. E. Remmers in U.S. Pat. No. 5,074,223 describes a free standing stacking shelf having a support defined by longitudinal extending rods and cross bars secured to a wire rectangular frame. A pair of stacking elements are pivotally mounted on pivot bars secured to corner portions of the frame. The legs of the stacking elements are biased outwardly into locking engagement with a locking rod to retain the stacking elements in generally vertical positions or normal to the horizontal plane of the supports. The legs are forced inwardly to release them from the locking rods whereby the stacking elements can be pivoted to folded positions adjacent the supports.

D. G. Santucci in U.S. Pat. No. 5,137,160 discloses a shelf for a locker having hinged first and second shelf members. Releasable latches lock the shelf members in fixed planar orientation with opposite ends of the shelf in engagement with the locker walls. Legs and supports are not used to retain the shelf in the locker.

M. E. Massouda, M. Snider, and D. L. Schwartz in U.S. Pat. No. 5,152,407 discloses a wire stackable and nestable rack having a support with crossed wires connected to a perimeter wire and side frames with leg members secured by welds to the perimeter wire. The side frames have bottom members that hook into top sections of side frames of a second rack stacked on a first rack. The side frames do not fold to positions adjacent the support.

G. E. McNamara and C. N. Hansen in U.S. Pat. No. 5,421,646 disclosed a legless locker shelf assembly having a pair of shelf members and an actuator cam operable to expand the shelf members into tight engagement with the side walls of the locker. The cam is rotatably mounted on one of the shelf members and engages teeth on the other shelf member to move the shelf members in opposite directions and hold the shelf members in their expanded positions. Legs are not used to support the shelf assembly in the locker.

R. M. Kurtis in U.S. Pat. No. 5,746,331 discloses a collapsible stand having legs and shelves for use with a school locker. The stand has a pair of flat rectangular shelves having corners. Upright linear legs pivotally connected to the corners of the legs allow the shelves to be moved from horizontal positions to folded upright positions. A stop bar secured to the lower shelf abuts against the front legs to retain the shelves in the horizontal positions.

F. Bingley discloses British Pat. No. 178,984, a shelf unit having horizontal shelves attached to upright end members. Vertically spaced key-hole shaped slots in the end members accommodate hook shaped or T-shaped extensions to connect the shelves to the end members.

SUMMARY OF THE INVENTION

The invention is a new and efficient shelf assembly that is useable in lockers to maximize locker space and provides a convenience and versatility shelf for holding objects. The shelf assembly is a plastic coated wire shelf hinged to U-shaped leg supports that can be folded adjacent the bottom of the shelf. The folded shelf assembly can be rotated to fit through a locker door. Once inside the locker, the leg supports are unfolded away from the shelf to horizontally support the shelf above the floor of the locker. The leg supports have legs with upper ends that fit in leg locking connectors secured to the corners of the shelf to lock the legs in place generally normal to the horizontal plane of the shelf. The legs can be spread apart to release the legs from the leg locking connectors so the leg supports can be moved to the folded position adjacent the bottom of the shelf. The shelf assembly has a tight fit inside a standard size locker. The plastic coated wire and metal frame of the shelf assembly prevents rusting and scratching. Two or more shelf assemblies can be stacked inside the locker.

The shelf assembly has a platform or shelf comprising a peripheral frame having side and end members. A wire grid of crossed wire members are secured to the side and end members of the frame. The frame and wire members are coated with a plastic material, such as polyethylene, to inhibit rust of the metal wires and frame. The plastic material also prevents scratching and marring of the floor and side walls of a locker or cabinet containing the shelf assembly. The shelf is retained in a generally horizontal position in the locker with a pair of U-shaped leg supports. Connectors secured to the corners of the shelf pivotally accommodate the leg supports and releasably retain the leg supports in upright positions or positions normal to the horizontal plane of the shelf. Each U-shaped leg support has a horizontal base and upright legs joined to the opposite ends of the base. The upper ends of the legs have inwardly directed projections or short cylindrical members. The base, legs and projections are coated with a plastic material. The U-shaped leg support is a U-shaped spring that biases the legs inwardly into cooperative engagement with the connectors to retain the U-shaped leg support in a shelf supporting position. Each connector has a downwardly directed member having a hole for accommodating the projection of a leg and flanges engageable with a portion of the legs to retain the leg in a position generally normal to the shelf. The leg can be moved outwardly away from the connector and flanges whereby the U-shaped leg support can be pivoted to a folded position adjacent the shelf.

The preferred embodiment of the shelf assembly has a generally rectangular frame comprising a continuous upright band secured to longitudinal and transverse linear wire members. The wire members are arranged in a Cartesian pattern or crossed grid. Intersecting portions of the wire members are secured by welds. The entire frame is covered with a protective coat or layer of plastic materials, such as polyethylene, to inhibit rust and scratching of a locker or other surfaces that may be engaged by the frame. The wire members are secured in a cartesian plane to the bottom edges band whereby the frame has end and side barriers that prevent objects from moving off the shelf. The band is a generally flat metal member that longitudinally and laterally strengthens the shelf. A pair of U-shaped leg supports retain the shelf in a generally horizontal position on a support, such as the floor of a locker. Each leg support is a U-shaped spring having a continuous metal wire or rod with a horizontal base joined to upright legs. The upper ends of the legs have inwardly directed projections or cylindrical members. The entire wire is covered with a coat or layer of plastic material to inhibit rust and damage to the wire and surfaces adjacent to the frame. When the U-shaped leg support is at its at-rest position, the legs are inclined upwardly and inwardly toward each other. Bending the legs to vertical positions causes the legs to have an inwardly directed biasing force. The legs are operatively associated with connectors secured to corner portions of the frame. Each connector has a horizontal portion secured to the wire of the frame and a downwardly directed portion for accommodating a portion of a leg. The downwardly direct portion has outwardly directed upright flanges providing an upright pocket between the flanges. A hole located above the pocket accommodates a projection to pivotally mount the leg on the connector. The connector is a one-piece metal member covered with a coating of plastic material. The connectors retain the legs in vertical positions whereby the biasing action of the legs retain the legs in the pockets between the flanges thereby preventing rotation of the leg supports relative to the connectors. The legs must be laterally moved away from the connectors against the biasing of the legs to move the legs out of the pockets whereby the leg supports can be pivoted to a folded position adjacent the bottom of the shelf.

DESCRIPTION OF THE FOLDABLE SHELF ASSEMBLY OF THE INVENTION

Figure 1:
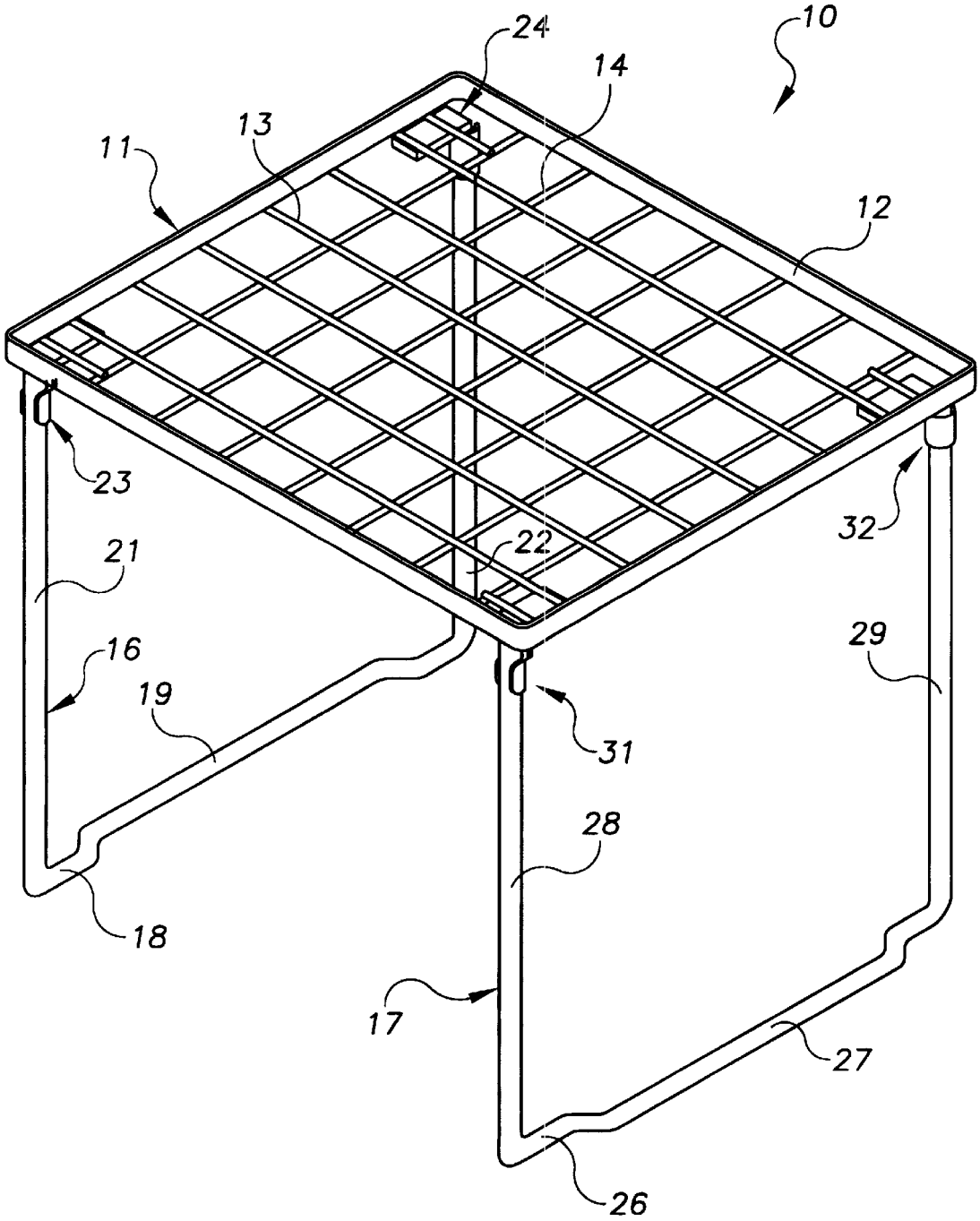
FIG. 1 is a perspective view of the foldable shelf assembly of the invention.
Figure 2:
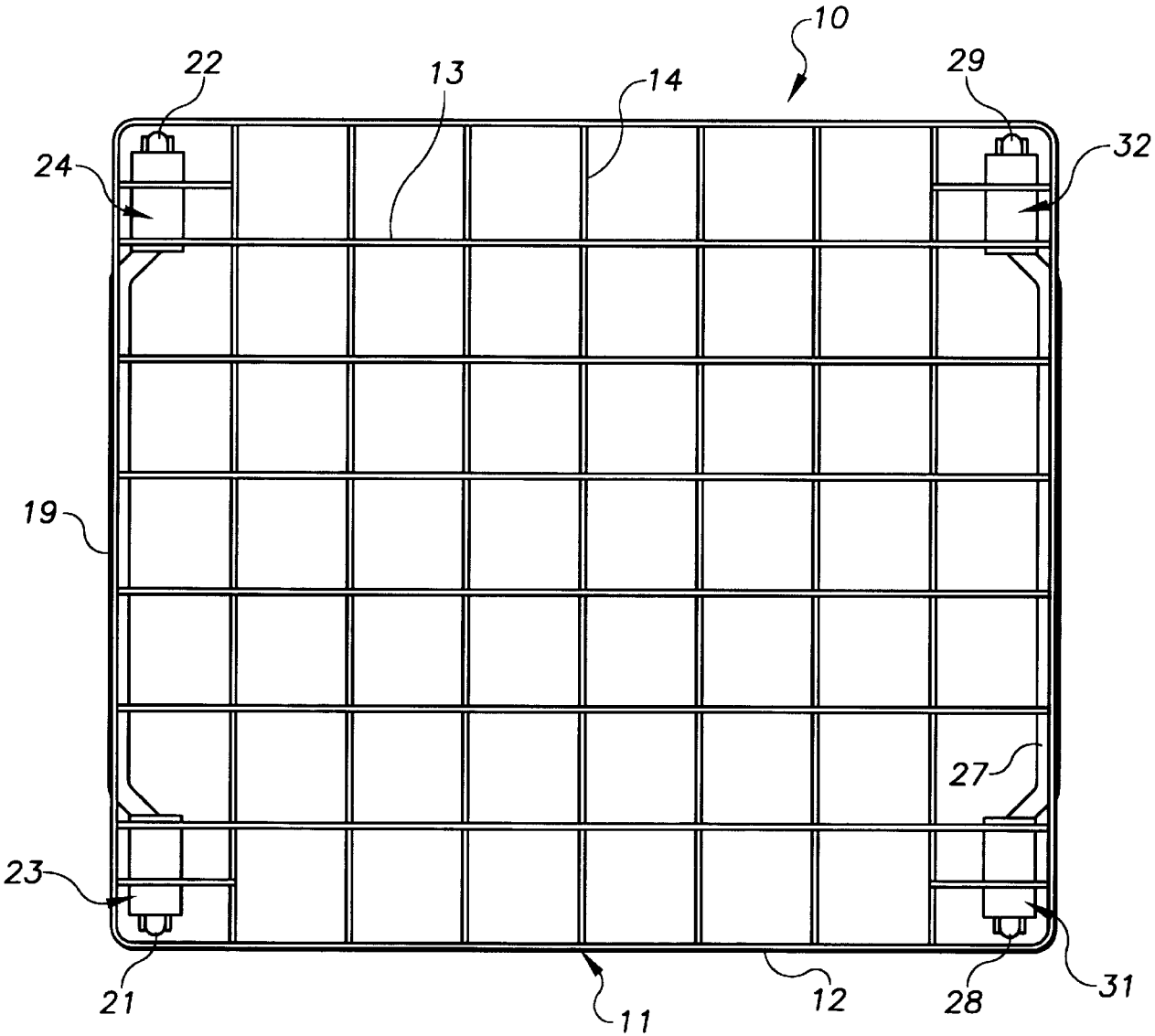
FIG. 2 is an enlarged top plan view thereof.
Figure 3:
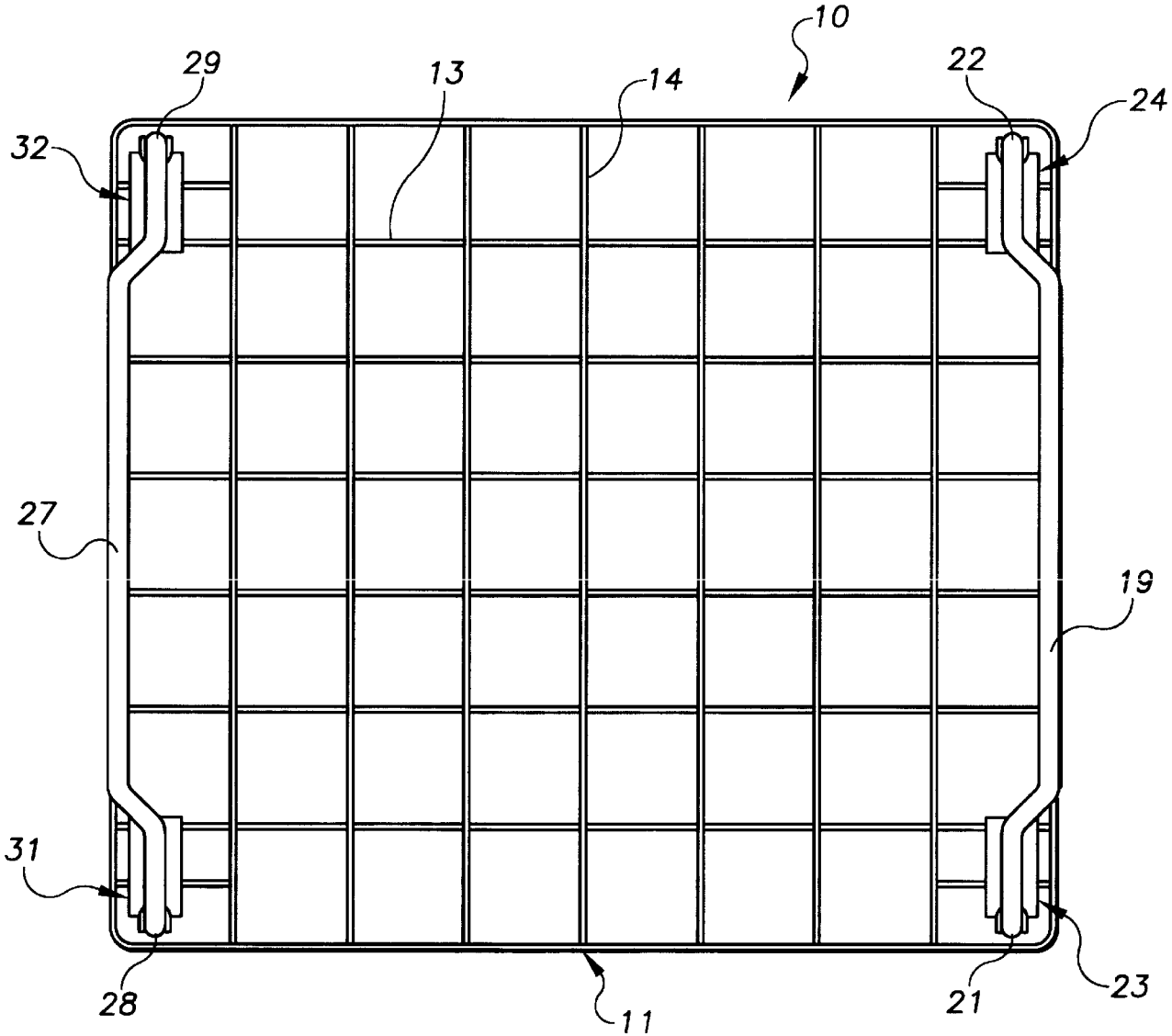
FIG. 3 is an enlarged bottom plan view thereof.
Figure 4:
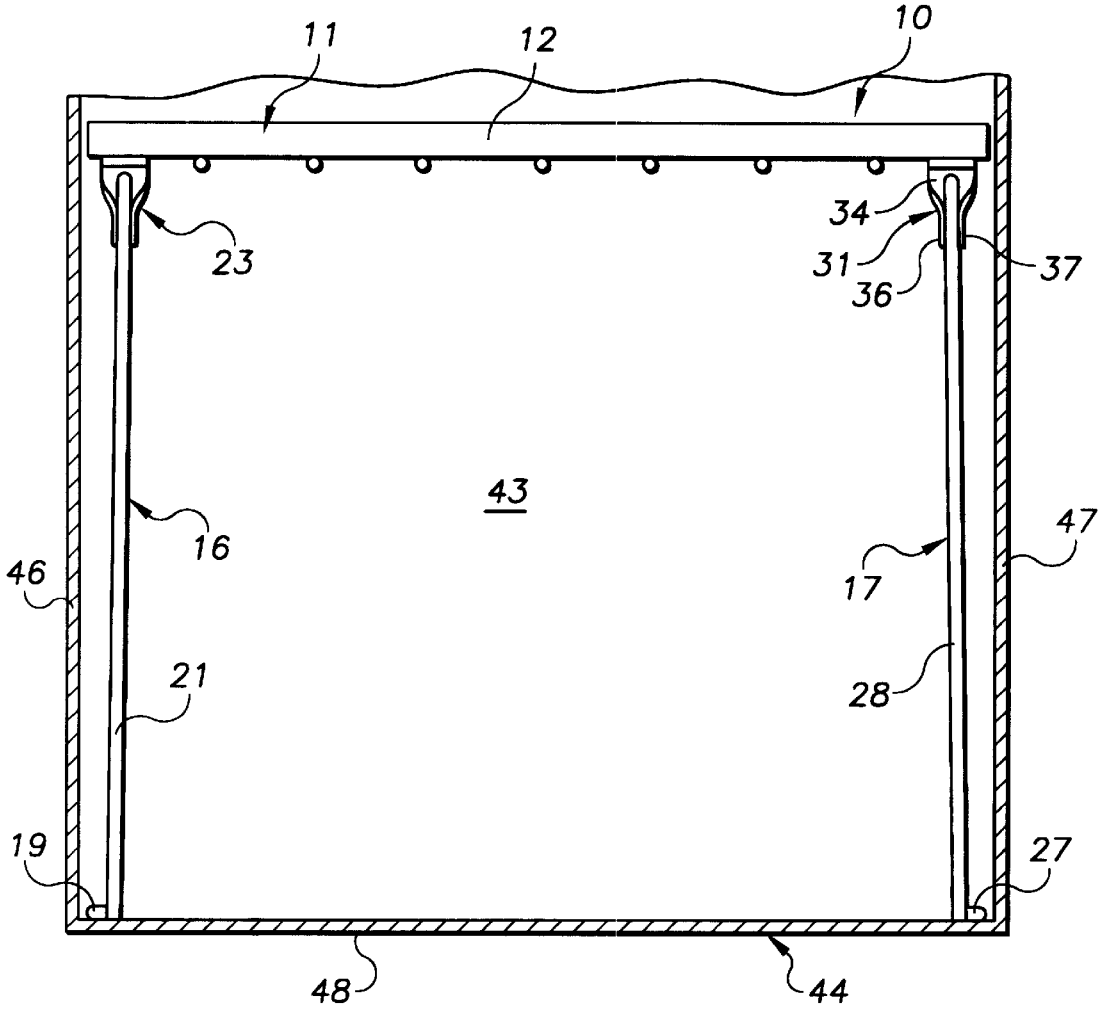
FIG. 4 is an enlarged front elevational view of the foldable shelf assembly of FIG. 1 located in a chamber of a locker.

The foldable shelf assembly 10 of the invention, shown in FIGS. 1–3 is a coated plastic wire shelf unit adapted to fit in the storage chamber of a conventional locker to support objects stored in the locker. The shelf assembly is a three-piece structure that does not require assembly to place it in a locker. Shelf assembly 10 has a generally rectangular platform or shelf 11 supported on a floor or support in a horizontal position with a pair of U-shaped leg supports indicated generally at 16 and 17. Shelf 11 can be square or have other shapes to fit in a particular space. As shown in FIG. 4, shelf assembly 10 is located with a tight fit in a conventional locker 44. Shelf assembly 10 can be used in other enclosures or as a free standing shelf unit. Shelf 11 has a peripheral frame 12 and a crossed rod grid comprising rod or wire members 13 and 14. The opposite ends of members 13 and 14 are secured to frame 12. The crossed portions of members 13 and 14 are secured together with welds. Members 13 and 14 are metal rods welded together. Frame 12 has a metal band 12B having a rectangular cross section that extends upwardly from the crossed rod grid to provide stops or ribs that prevent objects from falling off of the shelf. The rods 13 and 14 are arranged in Cartesian coordinates with the cartesian plane located adjacent the bottom edge of band 12B. The entire shelf 11 is covered with a plastic coat or layer 12A to prevent rusting of the metal rods and metal frame and scratching of the walls of a locker or other enclosures accommodating shelf assembly 10.

Figure 6:
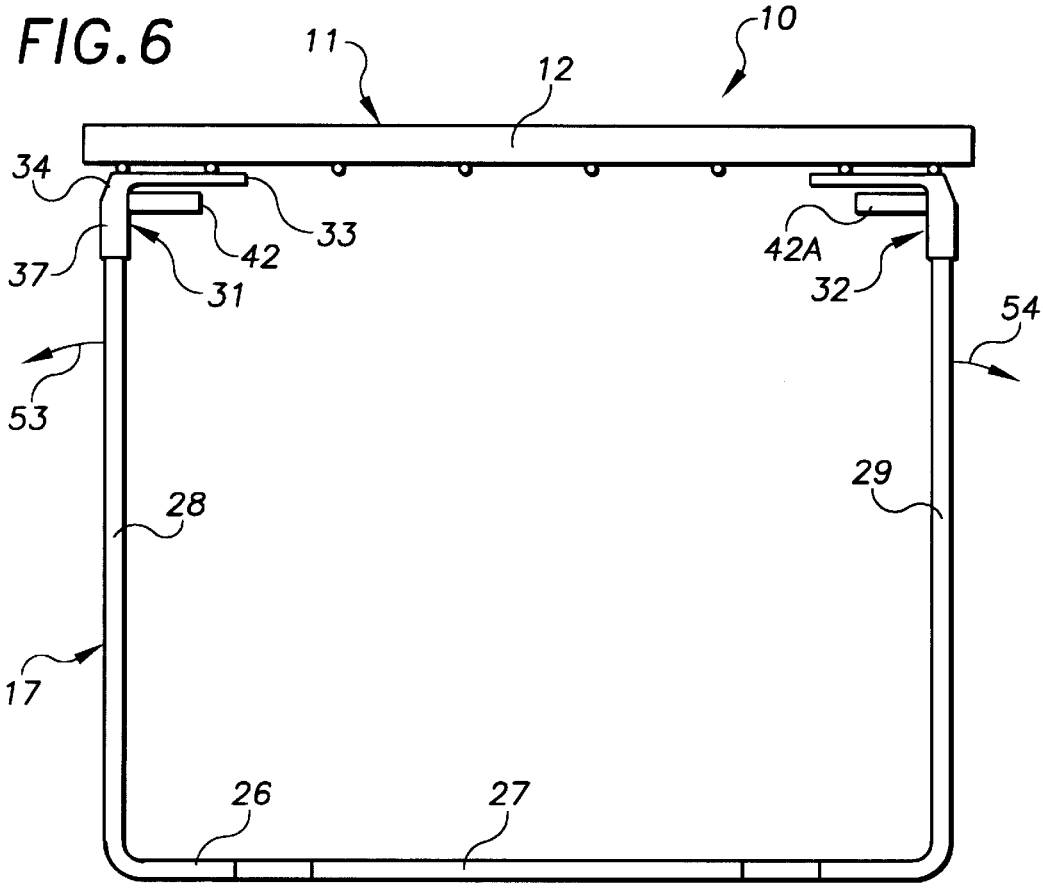
FIG. 6 is an enlarged side elevational view thereof.

Leg support 16 has a horizontal base 18 having an outwardly directed offset middle section 19. The opposite ends of base 18 are joined to upright linear legs 21 and 22. The upper ends of legs 21 and 22 have inwardly turned projections pivotally connected to leg locking connectors 23 and 24. Legs 21 and 22 are releasable from connectors 23 and 24 to allow leg supports 21 and 22 to be folded adjacent the bottom of shelf 11, as shown in FIG. 6. Leg support 17 has the same structure as leg support 16. Support 17 has a base 26 with an outward offset middle section 27 and upright linear legs 28 and 29. The upper ends of legs 28 and 29 have inwardly turned projections 42 and 42A, shown in FIG. 7, pivotally mounted on leg locking connectors 31 and 32. The entire leg supports 16 and 17 are coated with a plastic, such as polyethylene.

Figure 14:
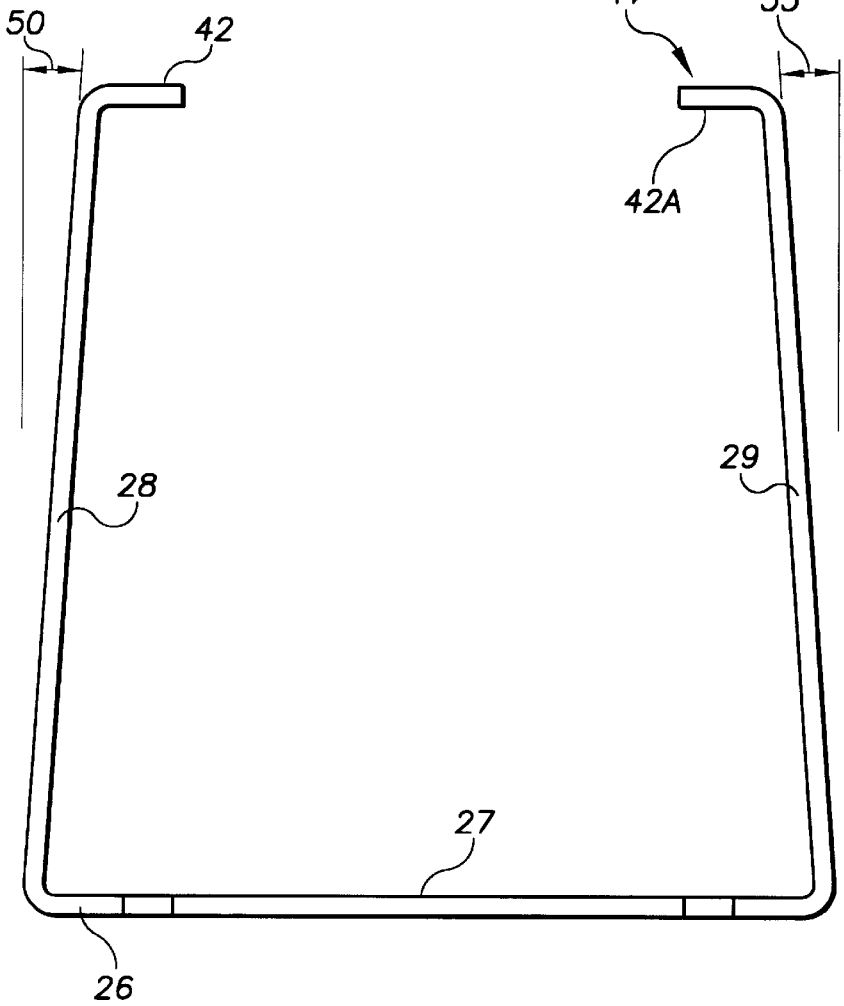
FIG. 14 is a front elevational view of a leg support removed from the shelf.
Figure 15:
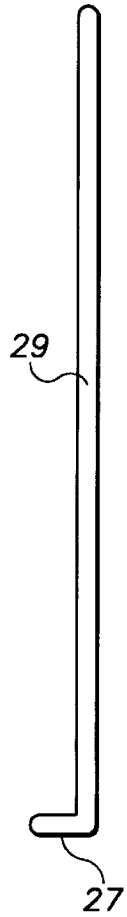
FIG. 15 is a side elevational view of the leg support of FIG. 14.
Figure 16:
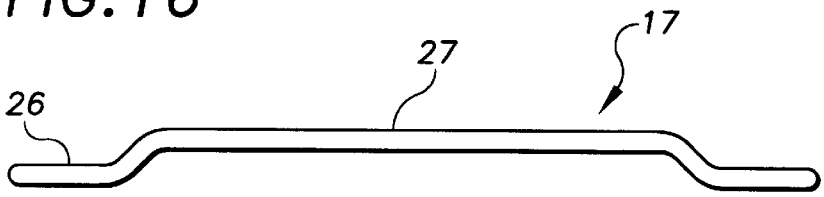
FIG. 16 is a bottom plan view of FIG. 14.

As shown in FIGS. 14 to 16, leg support 17 is shown apart from shelf 11 in its normal non-biased position. Base 26 has opposite ends joined to upwardly and inwardly extended legs 28 and 29. The upper ends of legs 28 and 29 have inwardly directed cylindrical projections 42 and 42A. The entire leg support 17 is a single rigid U-shaped metal wire 40 coated with a plastic material 45 to prevent rusting of wire 40. The wire 40 is a U-shaped spring that normally retains legs 28 and 29 inclined inwardly at angles 50 and 55 of about 5 degrees inwardly from vertical planes. Other angles can be used to locate legs 28 and 29 in inwardly directions. When the legs 28 and 29 are spread apart, the wire functions as a spring to bias the legs 28 and 29 inwardly toward each other.

Figure 5:
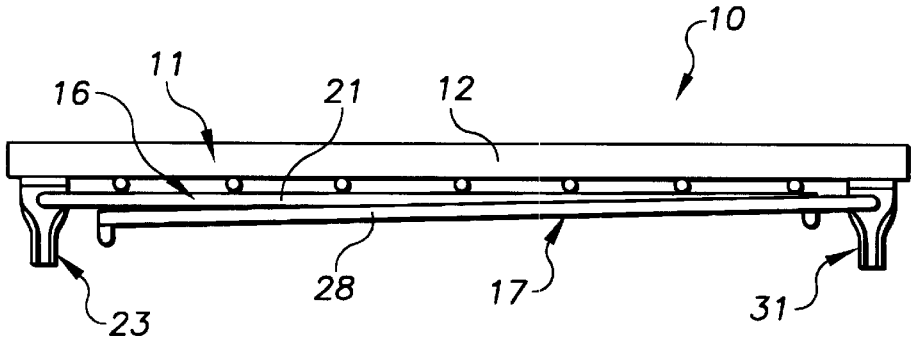
FIG. 5 is an enlarged front elevational view of the foldable shelf assembly of FIG. 1 showing the legs in their folded locations.
Figure 7:
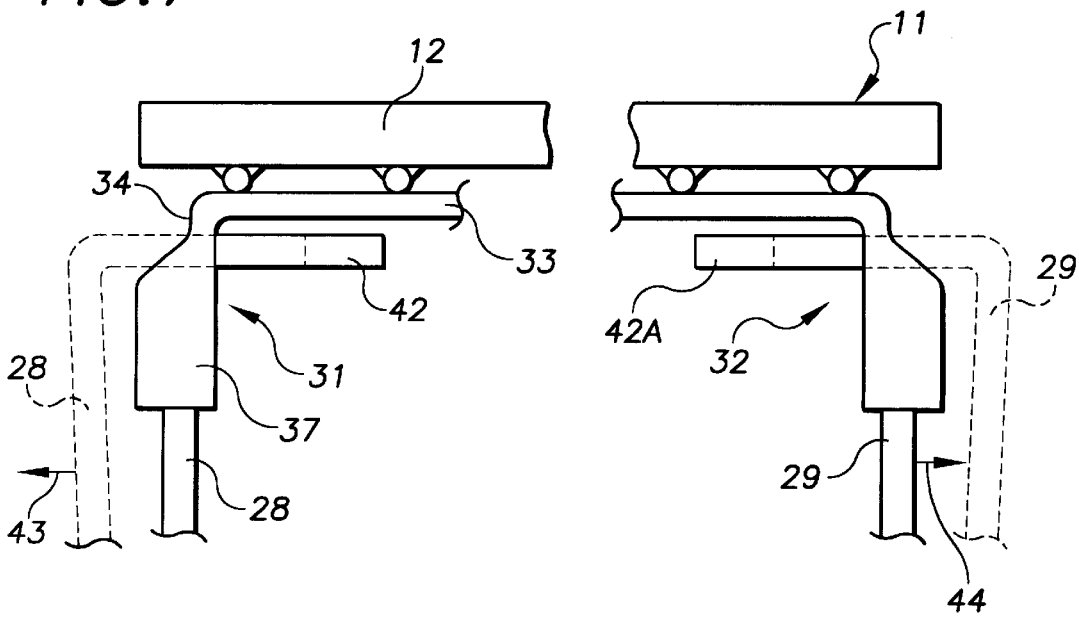
FIG. 7 is an enlarged fragmentary side elevational view of the leg locking connectors that pivotally connect the legs to the shelf.
Figure 8:
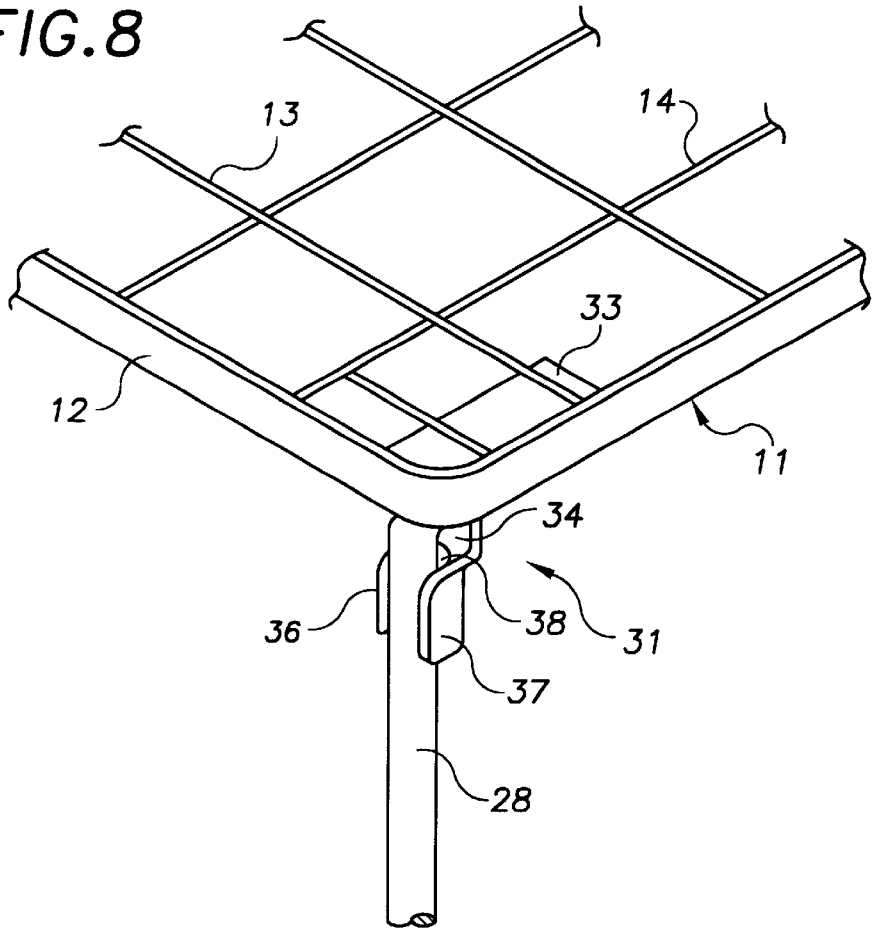
FIG. 8 is a perspective view of a corner of the foldable shelf assembly of FIG. 1.

As shown in FIGS. 6 and 7, legs 28 and 29 are retained in assembled relation with leg locking connectors 31 and 32 by the biasing or spring characteristics of the entire U-shaped leg support 17. Legs 28 and 29 are spread apart, as shown by arrows 53 and 54 in FIG. 6, to move the upper ends of legs 28 and 29 out of the pockets between flanges 36 and 37. Legs 28 and 29 are free to pivot to a folded position, as shown in FIG. 5 adjacent the bottom of shelf 11. Leg support 16 is also folded by spreading its legs and pivoting the leg support 16 to a folded position adjacent the bottom of shelf 11. Shelf 11, and leg supports 16 and 17, when folded, comprises a relatively flat structure that fits into a flat box for shipping and storage. This flat structure also facilitates placement of shelf assembly 10 in a chamber of an enclosure, such as a locker.

Figure 9:
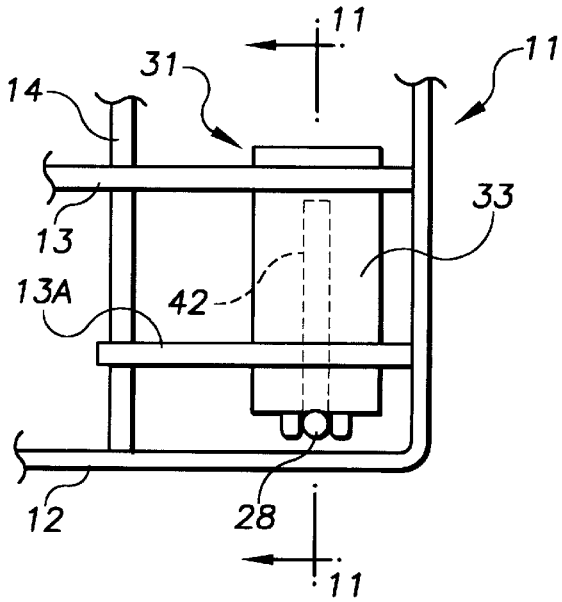
FIG. 9 is a top view of FIG. 8.
Figure 10:
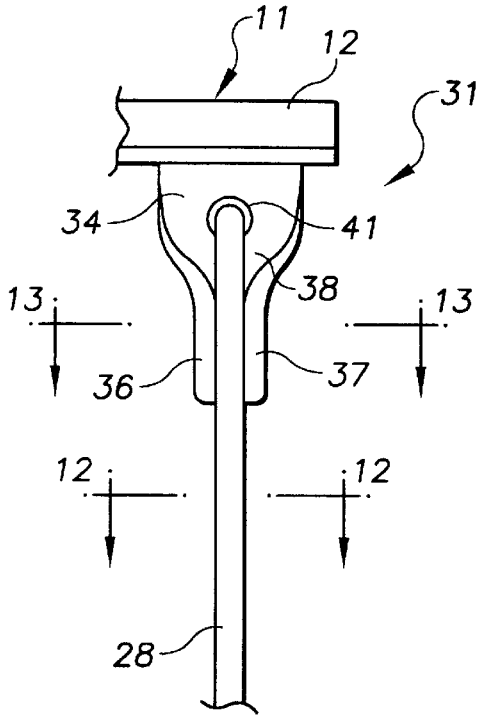
FIG. 10 is a front elevational view of FIG. 9.
Figure 11:
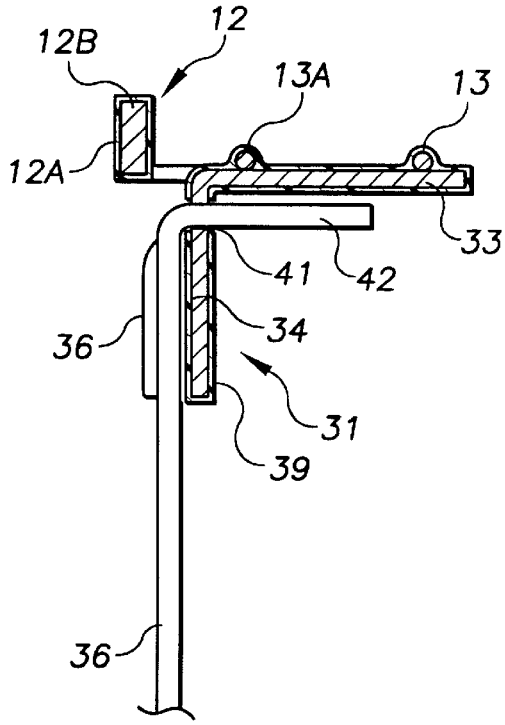
FIG. 11 is a sectional view taken along the line 11—11 of FIG. 9.
Figure 12:
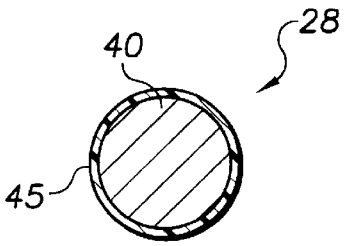
FIG. 12 is an enlarged sectional view taken along the line 12—12 of FIG. 10.
Figure 13:
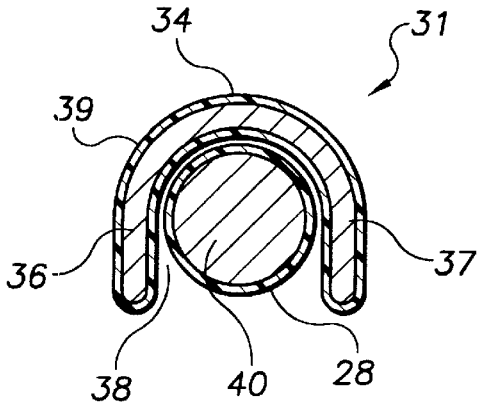
FIG. 13 is an enlarged sectional view taken along the line 13—13 of FIG. 10.

As shown in FIGS. 9–11, leg locking connector 31 is a right angle bracket having a flat horizontal member 33 secured to grid wires 13 and 13A adjacent the inside of a corner of frame 12. Member 33 is secured with welds to wires 13 and 13A. The bracket has a downwardly extended member 34 joined to the outer end of member 33. The lower portion of member 34 has a U-shape, as shown in FIG. 13. Outwardly directed vertical flanges 36 and 37 provide an upright pocket or groove 38 accommodating an upper portion of leg 28 and retaining leg 28 in an upright locked position. The entire leg locking connector 31 is covered with a plastic coat or layer 39. Leg 28, as shown in FIG. 12, has an outside coat or layer 40 of plastic. Member 34 has a hole 41 accommodating a right angle projection 42 of leg 28. Shelf 11 is supported on leg projection 42. Leg locking connectors 23, 24 and 32 have the same structure and function as leg locking connector 31.

As shown in FIG. 4, foldable shelf assembly 10 is located in a chamber or space 43 in an enclosure 44. Enclosure 44 can be a closet, cabinet, locker or similar structure. Enclosure 44 has side walls 46 and 47 and a bottom wall 48. Frame 12 extends between side walls 46 and 47 and the bases of leg supports 16 and 17 rest on bottom wall 48 adjacent side walls 46 and 47. The frame 12 is located adjacent the side and end walls door frame of enclosure 44 to ensure a tight fit of the shelf assembly 10 in the enclosure. A second shelf assembly 10 can be stacked on top of shelf assembly 10.

While there has been shown and described a preferred embodiment of the foldable shelf assembly of the invention, it is understood that changes in the structure, arrangement of structure and materials, and size of the shelf assembly can be made by a person skilled in the art without departing from the invention. The invention is defined in the following claims.

We claim:

1. A shelf assembly comprising: a shelf, U-shaped leg supports connected to the shelf to support the shelf in a generally horizontal position, said leg supports having upright inwardly biased legs, leg locking connectors secured to shelf, each of said connectors having a downwardly extended U-shaped member with outwardly extended upright laterally spaced elongated linear flanges and an upright elongated pocket between the flanges and a hole, each of said leg supports having a leg pivotally connected to each connector, said leg having an inwardly directed projection extended through said hole and a linear portion located between the flanges in the pocket, said leg being biased inwardly to retain the leg between the flanges in the pocket whereby the leg supports are retained in lock positions generally normal to said shelf, said projections being moveable outwardly relative to the holes to move the portions of the leg out of the pockets whereby the leg support can be pivoted to a folded position adjacent the shelf.

2. The shelf assembly of claim 1 wherein: the shelf has a rectangular frame, and crossed grid members secured to the frame, said frame and grid members having corner portions, said connectors being secured to said corner portions of the shelf.

3. A shelf assembly comprising: a shelf having a rectangular frame and crossed grid rod members secured to the frame, said grid rod members having corner portions, U-shaped leg supports connected to the corner portions of the rod members of the shelf to support the shelf in a generally horizontal position, said leg supports having a generally horizontal base and upright inwardly biased legs joined to the base, said legs having inwardly directed projections at the upper ends thereof, leg locking connectors secured to the corner portions of the rod members, each of said connectors having a downwardly extended U-shaped member with outwardly extended upright laterally spaced elongated linear flanges and an elongated upright pocket between the elongated linear flanges and a hole vertically aligned with the pocket pivotally accommodating one of said projections, each of said legs having a linear portion located between said flanges in said pocket to retain each said leg support in a position generally normal to said shelf, said legs being biased inwardly to retain the linear portions of the legs between the flanges in the pockets, said legs being movable outwardly to move the linear portions of the legs out of the pockets whereby the leg support can be pivoted to a folded position adjacent the shelf.

4. The shelf assembly of claim 3 wherein: said base, upright legs and inward projections of each U-shaped leg support includes a single continuous rigid wire that biases the legs inwardly toward each other to retain the portions of the legs between the flanges in the pockets and the projections in the holes.

5. The shelf assembly of claim 4 including: a layer of plastic material covering said wire.

6. The shelf assembly of claim 3 wherein: said base of each leg support has a linear outward offset section.

7. The shelf assembly of claim 3 wherein: said frame is a peripheral frame having an upright peripheral flange.

8. A shelf assembly comprising: a shelf having a generally rectangular fame and a plurality of longitudinal and transverse linear wire members secured to said frame, said wire members being arranged in a Cartesian pattern and secure at intersecting locations, said frame having four corner portions, first and second U-shaped leg supports for holding the shelf in a generally horizontal position, each leg support including a generally horizontal base having opposite ends and upright legs secured to the opposite ends of the base, said legs having upper ends, inwardly directed projections joined to said upper ends of the legs, connectors located adjacent each corner portion of the frame, means securing the connectors to at least one of said wire members, each connector having a horizontal portion secured to said one of said wire members and a downwardly extended member having a U-shaped portion having laterally spaced outwardly extended upright elongated linear flanges and an upright elongated pocket between the flanges accommodating a linear portion of a leg, and a hole located in the downwardly directed member above the pocket, said inwardly directed projections extended into the holes to pivotally connect the leg supports on the connectors, said legs being biased inwardly to retain the linear portion of the legs in the pockets between the flanges and the projections in the holes thereby holding the U-shaped leg supports generally normal to the shelf, said legs when moved outwardly against the inward biasing thereof remove the linear portions of the legs from the pockets whereby the leg supports can be pivoted to a location adjacent the shelf.

9. The shelf assembly of claim 8 wherein: said base, upright legs and inwardly directed projections of each U-shaped leg support includes a single continuous rigid wires that biases the legs inwardly toward each other to retain the portions of the legs in the pockets of connectors and the projections in the holes.

10. The shelf assembly of claim 9 including: a layer of plastic material covering said wire.

11. The shelf assembly of claim 8 wherein: said base has a linear outward offset section.

12. The shelf assembly of claim 8 wherein: said frame comprises a flange extended upwardly from the cartesian plane of the wire members.

13. The shelf assembly of claim 12 wherein: the flange is a flat metal band secured to the ends of the wire members.

14. The shelf assembly of claim 13 including: a layer of plastic material covering said band.

15. The shelf assembly of claim 8 wherein: the projections are cylindrical members.

* * * * *